US007221238B2

(12) United States Patent
Nakanishi et al.

(10) Patent No.: US 7,221,238 B2
(45) Date of Patent: May 22, 2007

(54) SUPERCONDUCTING FILTER DEVICE

(75) Inventors: Teru Nakanishi, Kawasaki (JP); Akihiko Akasegawa, Kawasaki (JP); Manabu Kai, Kawasaki (JP); Kazunori Yamanaka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/050,820

(22) Filed: Jan. 27, 2005

(65) Prior Publication Data

US 2005/0256010 A1 Nov. 17, 2005

Related U.S. Application Data

(63) Continuation-in-part of application No. 10/947,541, filed on Sep. 23, 2004, now abandoned.

(30) Foreign Application Priority Data

May 14, 2004 (JP) ..... 2004-145377
Oct. 28, 2004 (JP) ..... 2004-314094

(51) Int. Cl.
*H01P 1/203* (2006.01)

(52) U.S. Cl. ..... 333/99 S; 333/205; 505/210; 505/700; 505/866

(58) Field of Classification Search ..... 333/99 S, 333/205; 505/210, 700, 866
See application file for complete search history.

(56) References Cited

U.S. PATENT DOCUMENTS 5,172,084 A * 12/1992 Fiedziuszko et al. ..... 333/204
5,721,195 A * 2/1998 Grothe et al. ..... 505/210
5,965,494 A * 10/1999 Terashima et al. ..... 505/210
6,360,112 B1 * 3/2002 Mizuno et al. ..... 505/210
6,463,308 B1 * 10/2002 Wikborg et al. ..... 505/210
6,532,377 B1 * 3/2003 Terashima et al. ..... 505/210
6,778,042 B2 * 8/2004 Terashima et al. ..... 333/205

FOREIGN PATENT DOCUMENTS

JP 2001-102809 4/2001

OTHER PUBLICATIONS

A. Enokihara, et al.; "High-Tc Superconducting High-Power Filters Using Elliptic-Disk Resonators"; Electronics Information Communication Electronics Society; Electronics Society meeting papers; 1998; pp. 391-392./Discussed in the specification.

* cited by examiner

*Primary Examiner*—Robert Pascal
*Assistant Examiner*—Kimberly E Glenn
(74) *Attorney, Agent, or Firm*—Armstrong, Kratz, Quintos, Hanson & Brooks, LLP

(57) ABSTRACT

A compact superconducting filter device can easily change a bandwidth and a center frequency without changing a pattern or shape of the filter. A filter pattern is formed on a substrate made of a dielectric material. The filter pattern is made of a superconductor material. A signal input line and a signal output line are formed on the substrate so as to extend from a periphery of the filter pattern. An adjust plate is located above the filter pattern with a predetermined distance therebetween. The adjust plate is formed of one of an electrically conductive material, a superconductive material and a dielectric material.

15 Claims, 10 Drawing Sheets

SUPERCONDUCTING FILTER DEVICE

CROSS-REFERENCE TO THE RELATED APPLICATIONS

This is a continuation-in-part application of application Ser. No. 10/947,541 filed Sep. 23, 2004 now abandoned.

BACKGROUND OF THE INVENTION

1. Field of the Invention

The present invention generally relates to superconducting filter devices and, more particularly, to a superconducting filter device used for a receiver amplifier provided in a base station of a portable telephone communication system.

2. Description of the Related Art

In recent years, with the explosive development and popularization of portable telephones, there is a demand for development of a signal transmission technique that enables a high-speed, large-capacity signal transmission. As a technique which satisfies such as demand, there is suggested a technique using a superconducting filter as a frequency band filter used for a receiver amplifier provided in a base station of a portable telephone communication system.

A superconducting material usable as the frequency band filter is suitable for a microstrip line type filter since a surface resistance thereof is much smaller than that of a normal electrically conductive material even in a high-frequency range. Problems lie in putting such a superconducting filter in practical use, such as, for example, a problem in producing a low-temperature environment, have been greatly eliminated.

Recently, a superconducting filter for a receiver, which uses a superconductor, has been put in practical use. By using such a superconducting filter also for a transmitter circuit, it can be expected to eliminate distortion generated in an amplifier.

For example, Japanese Laid-Open Patent Application No. 2001-102809 suggests a method of adjusting a frequency band by using a separation plate that is located between and above adjacent resonators so as to adjust coupling between the resonators by shifting the separate plate upward or downward.

Additionally, "High-Tc Superconducting High-Power Filters Using Elliptic-Disc Resonators", 1998 electronics information communication electronics society, electronics society meeting papers, p.p. 391–392 discloses an elliptic resonator used for adjusting frequency band of a superconducting filter. Further, "Elliptic-Disc Filters of High-Tc superconducting Films for Power-Handling Capability Over 100 W", IEEE Trans. Microwave Theory Tech., vol. 48, No. 7, pp. 1256–1264, July 2000 also discloses an elliptic resonator used for adjusting frequency band of a superconducting filter.

SUMMARY OF THE INVENTION

It is a general object of the present invention to provide an improved and useful superconducting filter device in which the above-mentioned problems are eliminated.

A more specific object of the present invention is to provide a compact superconducting filter device which can easily change a bandwidth and a center frequency without changing a pattern or shape of the filter.

In order to achieve the above-mentioned object, there is provided according to the present invention a superconducting filter device for filtering a high-frequency signal, comprising: a substrate made of a dielectric material; a filter pattern formed on the substrate and made of a superconductor material; a signal input line and a signal output line each formed on said substrate so as to extend from a periphery of the filter pattern; and an adjust plate located above said filter pattern with a predetermined distance therebetween.

In the superconducting filter device according to the present invention, said adjust plate may be formed of an electrically conductive material. The adjust plate may be formed of copper.

Alternatively, the adjust plate maybe formed of a superconductor material. The superconductor material may be selected from a group consisting of RBCO (element R is one of Y, Nd, Gd and Ho, and is a material of R—Ba—Cu—O), BSCCO (a material of Bi—Sr—Ca—Cu—O material), and CBCCO (CuBapCaqCurOx: $1.5<p<2.5$, $2.5<q<3.5$, $3.5<r<4.5$).

In the superconducting filter device according to the present invention, said adjust plate may comprise a substrate made of a dielectric material and a thin film of a superconductor material formed on a surface of the substrate.

In the superconducting filter device according to the present invention, the adjust plate may be formed of a dielectric material. The dielectric material may be selected from a group consisting of $LaAlO_3$, $TiO_2$, MgO, $CeO_2$, $ZrO_2$, sapphire and $Al_2O_3$.

In the superconducting filter device according to the present invention, the adjust plate may be positioned perpendicular to said filter pattern and the predetermined distance is provided between a lower edge of said adjust plate and said filter pattern. A thickness of said adjust plate may be smaller than a distance between said signal input line and said signal output line.

In the superconducting filter device according to the present invention, said filter pattern may have a substantially circular shape, and one of a notch and a protrusion may be provided on a part of an outer circumference of said filter pattern. The one of the notch and the protrusion may have a rectangular shape. The adjust plate may extend along a diametral line of said filter pattern passing said one of the notch and the protrusion. The adjust plate may extend along a diametral line of said filer pattern perpendicular to a diametral line of said filter pattern passing said one of the notch and the protrusion.

In the superconducting filter device according to the present invention, the substrate may be accommodated in a metal package, a surface of said substrate on which said filter pattern is formed may be covered by a cover of an electrically conductive material, and said filer pattern may be located within an enclosed space formed by said cover and said metal package. The adjust plate may be attached to an inner wall of said cover.

According to the present invention, there are two resonance frequencies generated in the filter pattern by locating the adjust plate above the filter pattern. By changing and adjusting the distance between the adjust plate and the filter pattern, the resonance frequency on the lower frequency side and the higher frequency side can be changed, which enables the bandwidth being wider or narrower. Additionally, a signal loss due to the adjust plate can be eliminated by forming the adjust plate by a superconductor material.

Other objects, features and advantages of the present invention will become more apparent from the following detailed description when read in conjunction with the accompanying drawings.

DETAILED DESCRIPTION OF THE PREFERRED EMBODIMENTS

Figure 1:
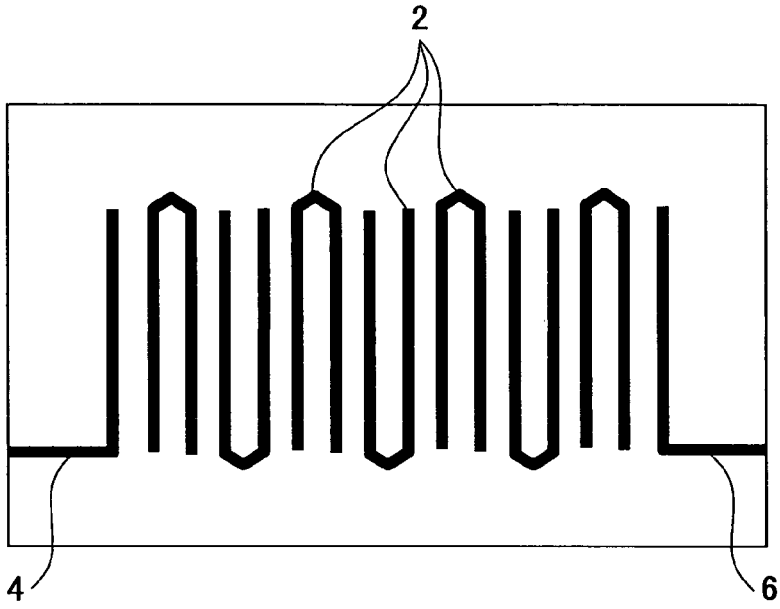
FIG. 1 is a plan view of a superconducting filter using hairpin-shaped resonators.
Figure 2:
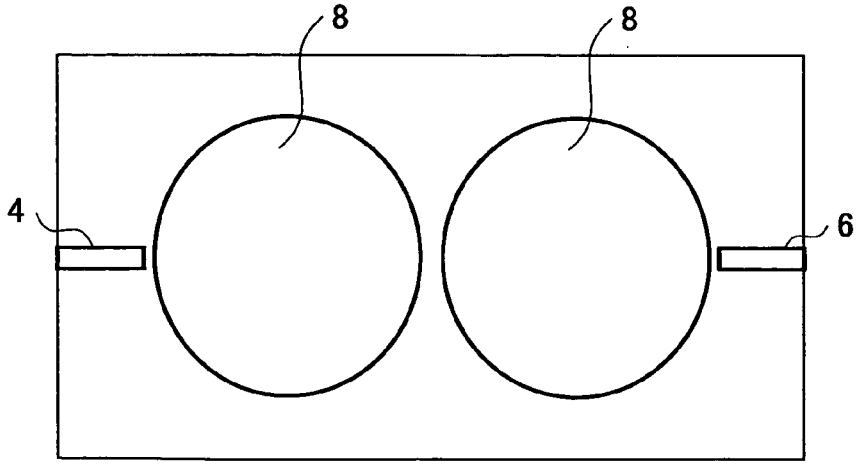
FIG. 2 is a plan view of a filter constituted by arranging a plurality of disc-shaped resonators.

Many superconducting filters for reception are constituted as a filter in which a plurality of hairpin type resonators are arranged between a signal input line 4 and a signal output line 6 as shown in FIG. 1. If the superconducting filter for reception of such a structure is used for a circuit for transmission, there may be a problem in that a superconducting state cannot be maintained depending on a condition of use. That is, the circuit for transmission is provided with a larger power than the circuit for reception and a current may be concentrated into a part of the filter constituted by the plurality of hairpin type resonators when a large power is applied thereto, which may result in an increase in the temperature of the semiconductor. Due to such an increase in the temperature, the temperature of the semiconductor may exceed a critical temperature, and, thus, it may be difficult to maintain the superconducting state.

Figure 3A:
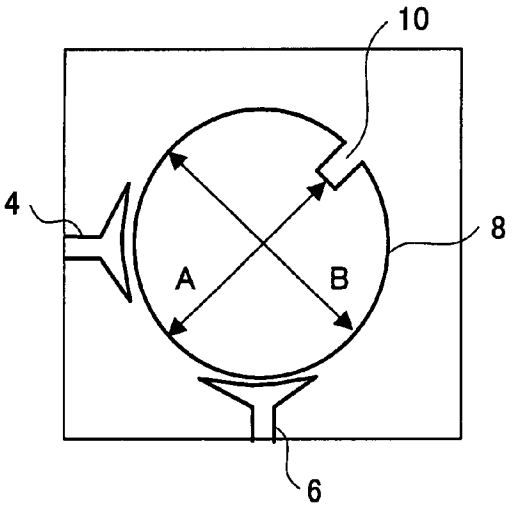
FIGS. 3A, 3B and 3C are plan views of superconducting filters using a disc-shaped resonator.

Thus, in order to improve withstand electric power of the superconducting filter for transmission, there is suggested a method for suppressing a current concentration by using a disc shape resonator. However, such a filter constituted by arranging a plurality of disc shape resonators requires a large area. The disc shape resonator uses TM11 mode, and, as shown in FIG. 3, a rectangular notch 10, a V-shaped notch 12 or a protrusion 14 is provided to a part of a disc pattern 8 so as to generate a turbulence in the electromagnetic field within the resonator so that tow resonances are generated in portions (indicated by A and B in the figure) that have different lengths on the disc pattern 8 to acquire a two stage filter by combining the resonances. That is, two resonators can be formed on one disc pattern.

In a superconducting filter, a bandwidth can be changed by adjusting coupling between resonators. If the filter having a disc provided with a notch or protrusion beforehand as shown in FIG. 3, it is required to determine the shape of the disc pattern by using electromagnetic field simulation so as to adjust the coupling between the two resonators formed on one disc pattern. Therefore, when changing a bandwidth, there may be a case in which a dis pattern must be fabricated again.

Figure 4:
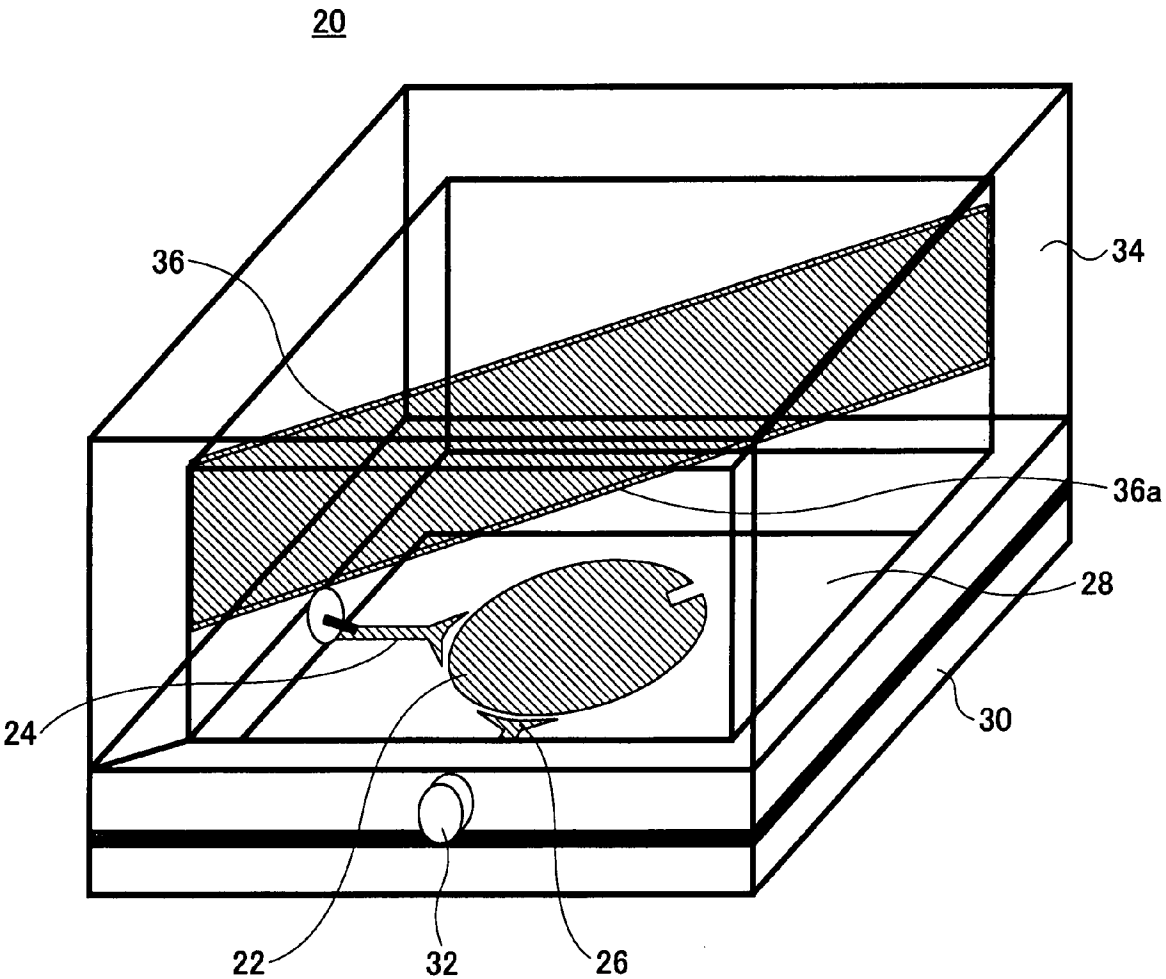
FIG. 4 is a perspective view of a superconducting filter device according to a first embodiment of the present invention.

A description will now be given, with reference to the drawings, of a superconducting filter device according to a first embodiment of the present invention. FIG. 4 is a perspective view of a superconducting filter device 20 according to a first embodiment of the present invention.

The superconducting filter device 20 comprises a resonator including a disc pattern 22 and a signal input line 24 and a signal output line 26 both extend from a periphery of the disc pattern 22. The disc pattern 22, the signal input line 24 and the signal output line 26 are formed on a substrate 28, which is made of a dielectric material, by using a high-temperature superconducting material. The disc pattern 22 has a generally circular shape, and used as a filter pattern that forms two resonators.

The superconducting filter device according to the present embodiment is a band-pass filter for especially filtering a high-frequency electric signal. More specifically, a description will be given of, as an example, a superconducting filter device such as one provided to a transmitter circuit of a communication system such as a cellular phone system. Presently, as for a superconductor material usable for the disc pattern 22, there are RBCO (element R is one of Y, Nd, Gd and Ho, and is a material of R—Ba—Cu—O), BSCCO (a material of Bi—Sr—Ca—Cu—O material), and CBCCO (CuBapCaqCurOx: $1.5<p<2.5$, $2.5<q<3.5$, $3.5<r<4.5$), etc. Additionally, as for a dielectric material usable for a substrate 28 on which the disc pattern 22 is formed, there are MgO, $LaAlO_3$, $Al_2O_3$, sapphire, $TiO_2$, $CeO_2$, etc.

The substrate 28 on which the disc pattern 22 is formed is enclosed in a metal package 30. The signal input line 24 and the signal output line 26, which extend from a periphery of the disc pattern 22, are pulled out of the metal package 30 through coaxial connectors 32, respectively. A cover 34 for high-frequency shielding is attached on an upper portion of the metal package 30, and the disc pattern 22 is situated in an enclosed space formed between the metal package 30 and the cover 34. The cover 34 is formed of an electrically conductive material and applied with gold plating, thereby providing a high-frequency shielding function.

In the present embodiment, an adjust plate 36 is provided in a space inside the cover 34. The adjust plate 36 is a thin plate of an electrically conductive material. The adjust plate 36 is fixed to an inner wall of the cover 34 so as to traverse above the disc pattern 22 and perpendicular to the disc pattern 22. Although a metal of a normal conductor (for example, copper) may be used for the material forming the adjust plate 36, a signal loss can be eliminated if a superconductor material is used similar to the disc pattern 22. Alternatively, a base of the adjust plate 36 may be formed by a dielectric material, and a thin film of a superconductor may be formed on a surface of the base. If the adjust plate 36 is formed of copper, the adjust plate and the superconducting filter device can be manufactured at a low cost since copper has a high conductivity and easy to obtain.

In the present embodiment, the disc pattern 22 has a rectangular notch 22*a* so that two resonators are formed on the disc pattern 22. The bandwidth of the filter can be changed by adjusting coupling between the two resonators. It should be noted that a center frequency of the filter also changes when changing the bandwidth. The adjust plate 36 is provided for adjusting the coupling between the resonators by changing the resonance frequencies of the two resonators. The rectangular notch or protrusion can provide a disc pattern having no sharp portion and easy to design.

Figure 5:
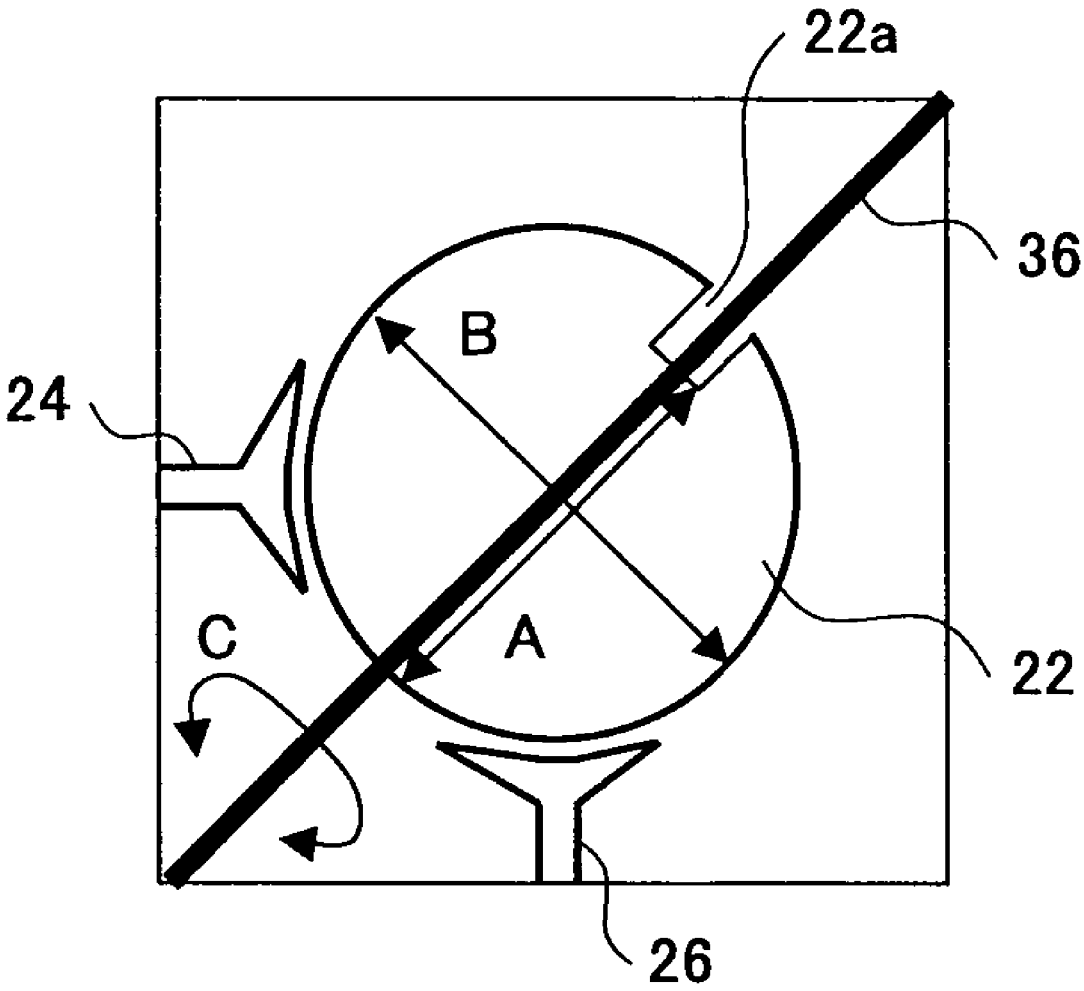
FIG. 5 is a plan view of a disc pattern and an adjust plate shown in FIG. 4 for showing a positional relationship therebetween.
Figure 6:
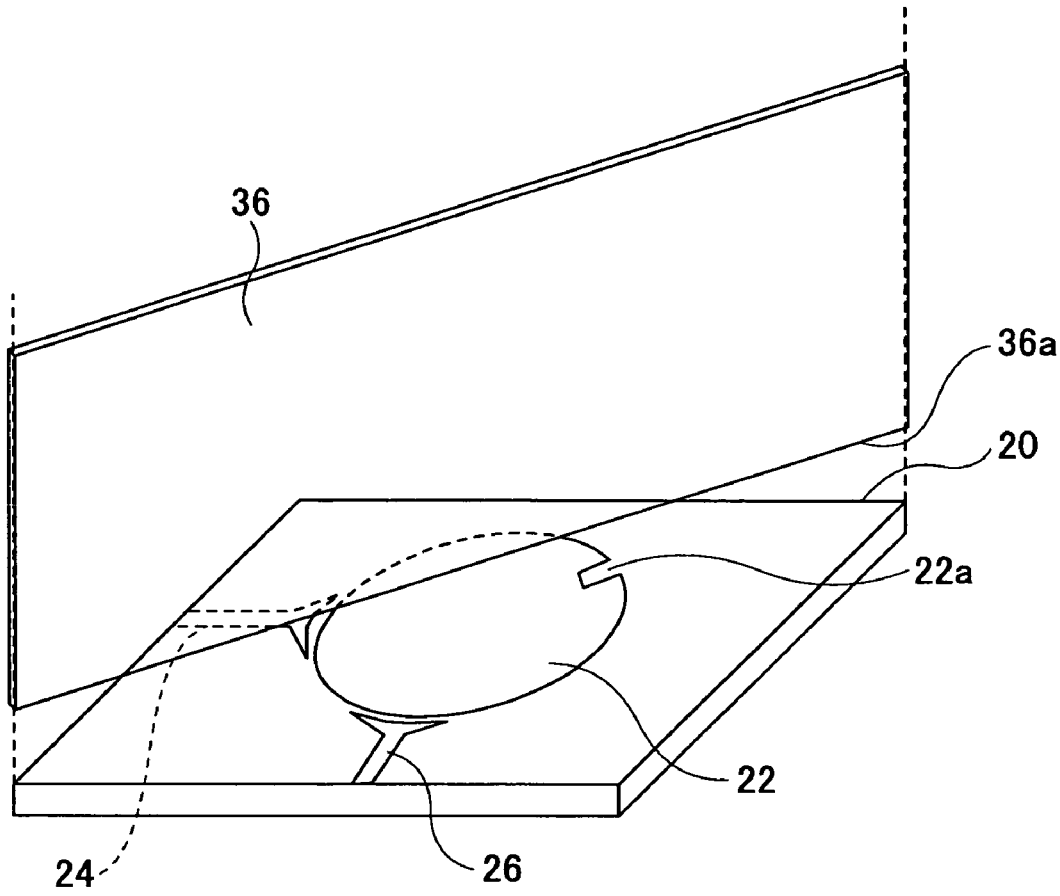
FIG. 6 is a plan view of the disc pattern and the adjust plate shown in FIG. 4 for showing the positional relationship therebetween.

FIG. 5 is a plan view showing a positional relationship between the disc pattern 22 and the adjust plate 36 shown in FIG. 4. FIG. 6 is a perspective view showing the positional relationship between the disc pattern 22 and the adjust plate 36 shown in FIG. 4. The adjust plate 36 is arranged along a diametral line of the disc pattern 22 passing a position where the notch 22*a* is provided. The signal input line 24 and the signal output line 26 are located on opposite sides with respect to the diametral line. Therefore, the thickness of the adjust plate 36 is set smaller than a distance between the signal input and output lines 24 and 26.

A lower edge 36*a* of the adjust plate 36 extends parallel to the surface of the disc pattern 22 at a position slightly apart from the disc pattern 22. By changing the distance between the lower edge 36*a* of the adjust plate 36 and the disc pattern 22, coupling between the two resonators formed on the disc pattern 22 is changed. That is, when the adjust plate 36 is arranged along the diametral line which passes the notch 22*a* of the disc pattern 22, the adjust plate 36 is perpendicular to a magnetic field of the resonance A having a shorter wavelength, and, thus, magnetic energy is reduced as the adjust plate 36 is brought closer to the disc pattern 22. It is assumed that the resonance frequency is increased with the reduction in the magnetic energy.

On the other hand, at the resonance B of a longer wavelength, the adjust plate 36 is parallel to the magnetic field, and, thus, there is less influence to the electromagnetic field. For this reason, in the filter characteristic, it is considered that the resonance frequency of the resonance A having a shorter wavelength shifts toward the higher frequency side. On the other hand, if the adjust plate 36 is arranged along a diametral line perpendicular to the diametral line passing the notch 22*a* of the disc pattern 22, the adjust plate 36 is parallel to the magnetic field of the resonance A having a shorter wavelength, thereby giving less influence to the electromagnetic filed. It is considered that the resonance frequency is increased with respect to the resonance B since the adjust plate 36 is perpendicular to the magnetic filed with respect to the resonance B having a longer wavelength and magnetic energy is reduced. Consequently, it is considered that in the filter characteristic, the resonance frequency of the resonance B of a lower frequency side having a longer wavelength shifts toward the higher frequency side.

In the present embodiment, the bandwidth and the center frequency of the filter can be adjusted using this phenomenon. It should be noted that the arrows A and B in FIG. 5 indicate directions of the resonances A and B, which coincide with directions of electric currents. Additionally, the arrow C indicates the direction of the magnetic field of the resonance A.

As mentioned above, the bandwidth of the filter can be adjusted by the structure in which the adjust plate 36 is merely attached to the inner wall of the cover 34. That is, there is no need to change the configuration or shape of the disc pattern 22, and the superconducting filter device having various bandwidths can be achieved by using one disc pattern 22 and only changing the distance between the adjust plate 36 and the disc pattern 22.

Although the adjust plate 36 is arranged to extend in the diametral line passing the notch 22*a* of the disc pattern 22 in the present embodiment, the bandwidth can be changed by arranging the adjust plate 36 in a direction perpendicular to the diametral line passing the notch 22*a*. Additionally, the bandwidth can also be changed by changing the extending direction of the adjust plate 36, changing the configuration of the adjust plate 36 or changing the material of the adjust plate 36 to a material that can provide influence to an electromagnetic field.

The inventors performed experiments by making a trial manufacture of the superconducting filter device shown in FIG. 4 by using a normal conductor so as to verify that the bandwidth is changed.

A description will be given below of the experiments.

When producing a trial device for experiments, the disc pattern and the signal input and output lines were not formed by a superconductor material but formed by copper which is an excellent electrically conductive material. A MgO substrate was used as the substrate on which the disc pattern is formed.

First, a copper (Cu) film was formed on the 20×20×0.5 mm MgO substrate, and the Cu film was processed according to a photolithography so as to form the disc pattern 22 and the signal input and output lines 24 and 26 as shown in FIG. 5. Then, electrodes were formed on ends of the signal input and output lines 24 and 26.

The thus-formed substrate 20 was put in a metal package having a gold plated surface, and the electrodes of the superconducting filter (which is not a superconductor but actually copper) are electrically connected to center conductors of coaxial connecters attached to the metal package. Thereafter, a gold plated cover was attached to the metal package so as to provide high-frequency shielding to complete the filter. Signal reflection and transmission characteristics of the filter was measured.

Figure 7:
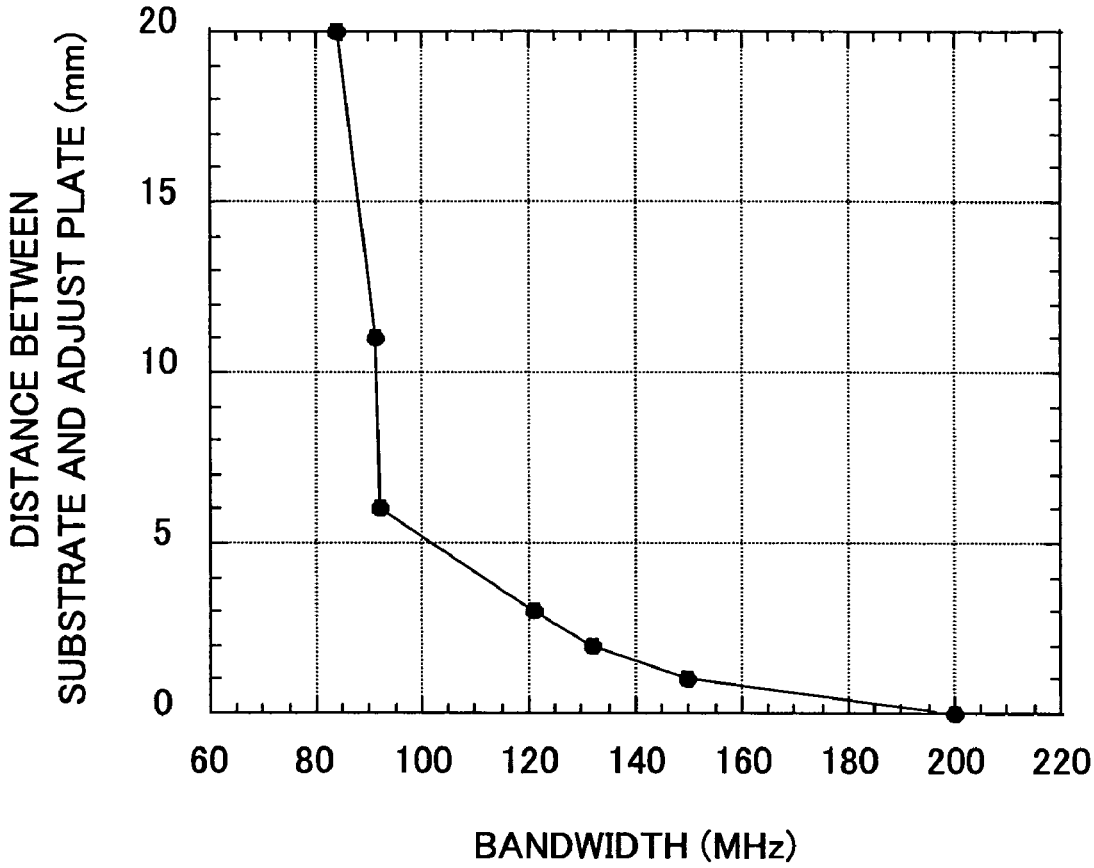
FIG. 7 is a graph showing changes in a bandwidth when a distance between a substrate surface and a lower edge of the adjust plate is varied.

The filter made as a trial had the center frequency of near 4 GHz, and a bandwidth of the filter was about 80 MHz. Then, an adjust plate (pure copper) having a thickness of 1 mm was attached inside the cover for high-frequency shielding as shown in FIG. 3 so as to adjust the resonator coupling, and evaluated the characteristics while changing the height of the adjust plate. That is, a change in the bandwidth when a distance between a lower edge of the adjust plate and the substrate surface (surface of the disc pattern 22) is changed was investigated. The result is shown in the graph of FIG. 7. It was confirmed that the bandwidth is increased from 80 MHz as the adjust plate is closer to the substrate surface. The bandwidth began to increase rapidly when the distance between the lower edge of the adjust plate and the substrate surface reached about 6 mm, and the bandwidth was increased up to 200 MHz in a state where the distance was zero, that is, the lower edge of the adjust plate was brought into contact with the disc pattern.

Figure 8:
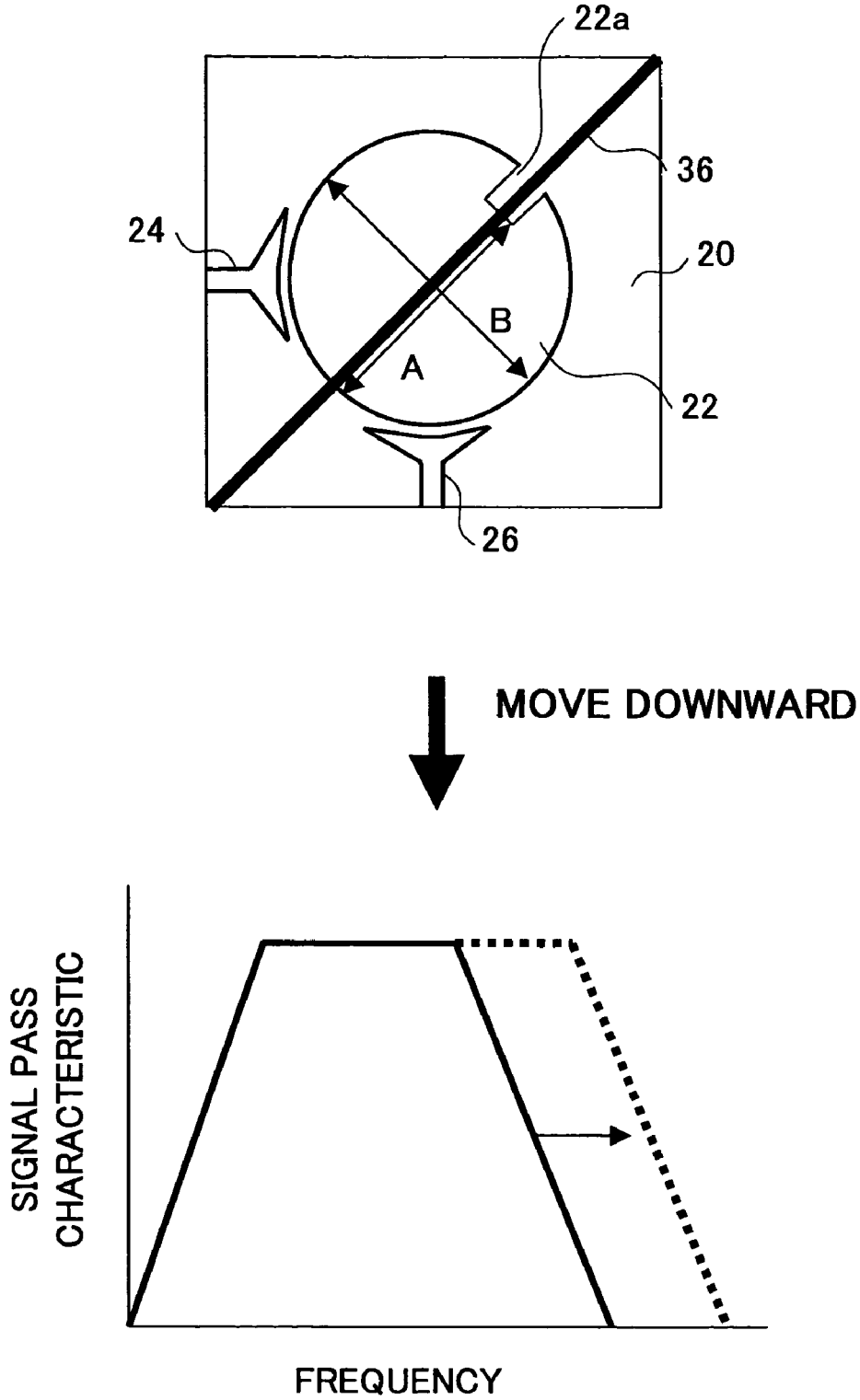
FIG. 8 is an illustration showing a change in a bandwidth when the adjust plate made of an electrically conductive material is arranged to extend in a direction along a diameter which passes a notch of the disc pattern.
Figure 9:
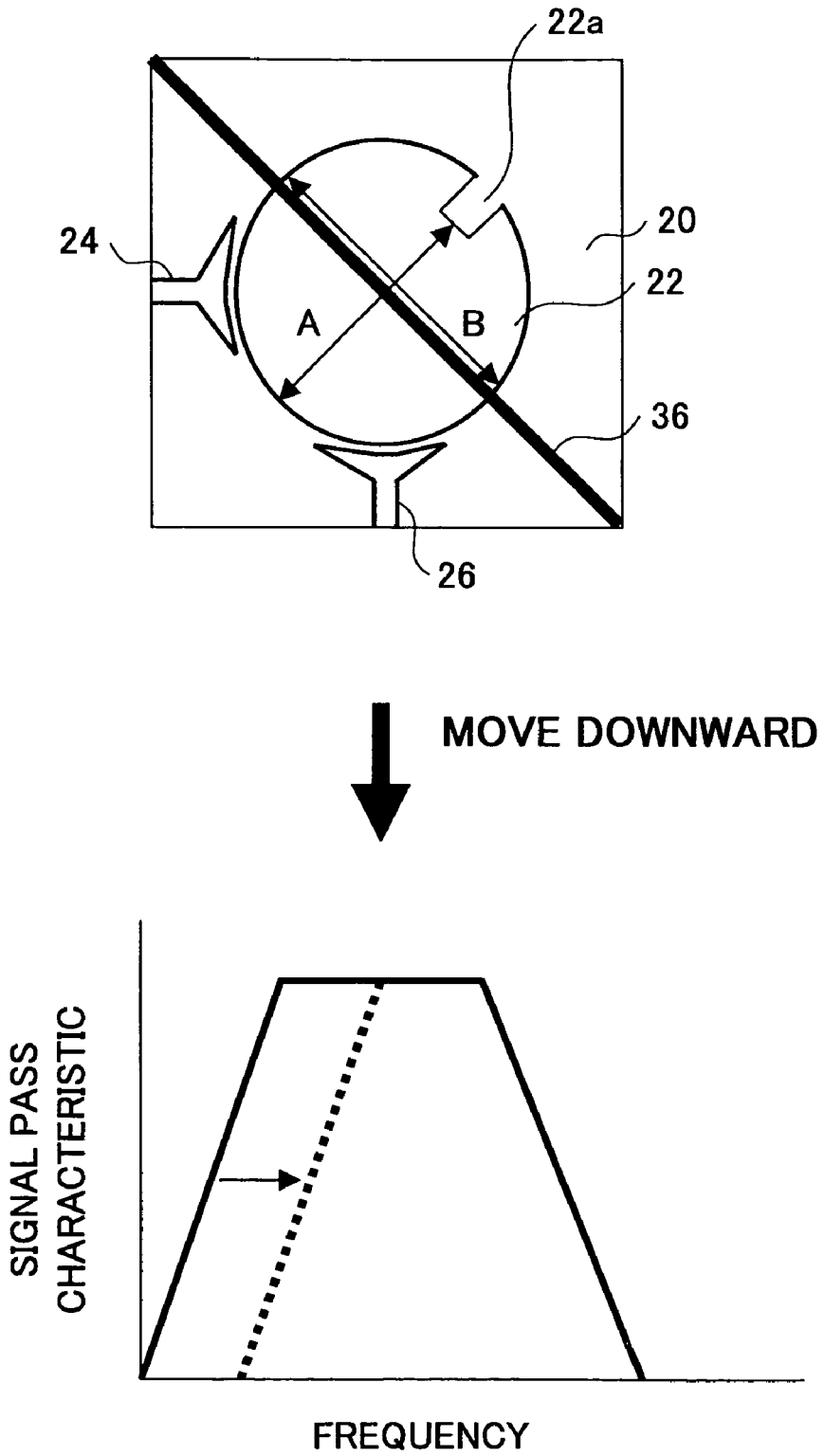
FIG. 9 is an illustration showing a change in a bandwidth when the adjust plate made of an electrically conductive material is arranged to extend in a direction perpendicular to a diameter which passes a notch of the disc pattern.

Additionally, a difference in the change in the bandwidth due to positions of the adjust plate was investigated using the above-mentioned trail device. As shown in FIG. 8, when the adjust plate was arranged along the diametral line passing the notch of the disc pattern, the high-frequency end of the bandwidth (signal pass characteristic) moves toward the higher frequency side as indicated by a dashed line in the figure, which results in a wider bandwidth. On the other hand, as shown in FIG. 9, when the adjust plate was arranged a diametral line perpendicular to the diametral line passing the notch of the disc pattern, the low-frequency end of the bandwidth (signal pass characteristic) moves toward the higher frequency side as indicated by a dashed line in the figure, which results in a narrower bandwidth.

Although the filter pattern was made of not a superconductor material but copper in the experiments performed with the above-mentioned trial device, it is understandable that the same effect can be obtained when using a filter pattern of a superconductor material since the change in the bandwidth is an effect of the mounting configuration.

Additionally, although a signal loss increases when using copper, which is a normal conductor, for the adjust plate, such a signal loss can be eliminated by using an adjust plate of a superconductor material. Further, the signal pass bandwidth can be changed by changing a position and a configuration of the adjust plate. For example, the signal pass bandwidth can be adjusted by slanting the adjust plate or forming a step in the adjust plate.

Figure 3B:
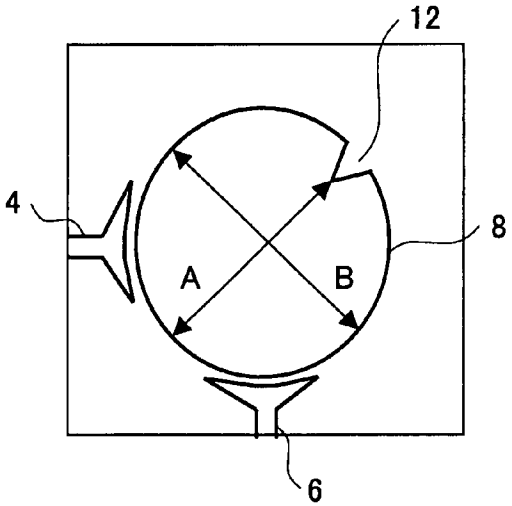
Figure 3C:
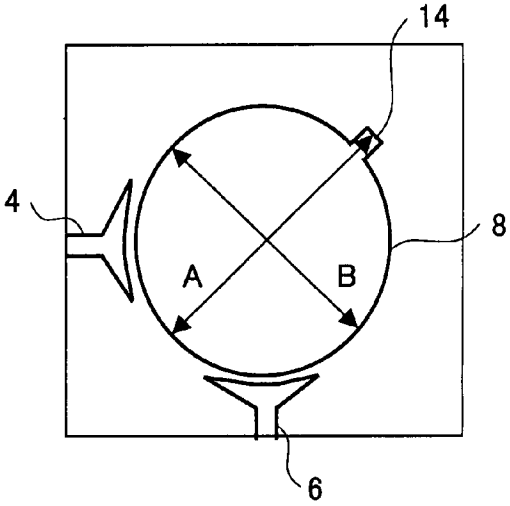

Additionally, although the two resonators are formed by providing the rectangular notch to the disc pattern as shown in FIG. 3 in the above-mentioned trial device, the V-shaped notch shown in FIG. 3B or the protrusion shown in FIG. 3C may be provided instead of the rectangular notch. Furthermore, two or more disc patterns may be provided in adjacent positions so as to form a plurality of resonators. Furthermore, the disc pattern is not limited to the circular shape, and an oval or a polygon may be used as the outer configuration of the disc pattern.

According to the superconducting filter device according to the above-mentioned embodiment, the signal pass bandwidth of the superconducting filter device is adjustable by changing the distance between the previously formed filter pattern and the adjust plate provided adjacent to the filter pattern. Accordingly, it is possible to produce superconducting filter devices having different signal pass bandwidths using the same filter pattern. Thereby, a number of processes in the design and trial of the filter pattern can be reduced, which results in reduction in the development period of the superconducting filter device. Additionally, it is easy to change the bandwidth of the already-formed superconducting filter device.

It should be noted that there is a limitation in miniaturization of the superconducting filter device according to the method (the above-mentioned Japanese Laid-Open Patent Application No. 2001-102809) of adjusting a frequency band by adjusting coupling between the resonators by shifting the separation plate above a position between the resonators, and the adjustment is only in one direction to make a narrower frequency bandwidth.

On the other hand, the superconducting filter device according to the present invention is compact, and the resonance frequency on the lower frequency side and the higher frequency side can be changed by changing the frequencies of the two resonances generated in the disc by moving upward or downward the adjust plate corresponding to the direction of resonance, which makes easy to increase or decrease the bandwidth as a filter.

Figure 10:
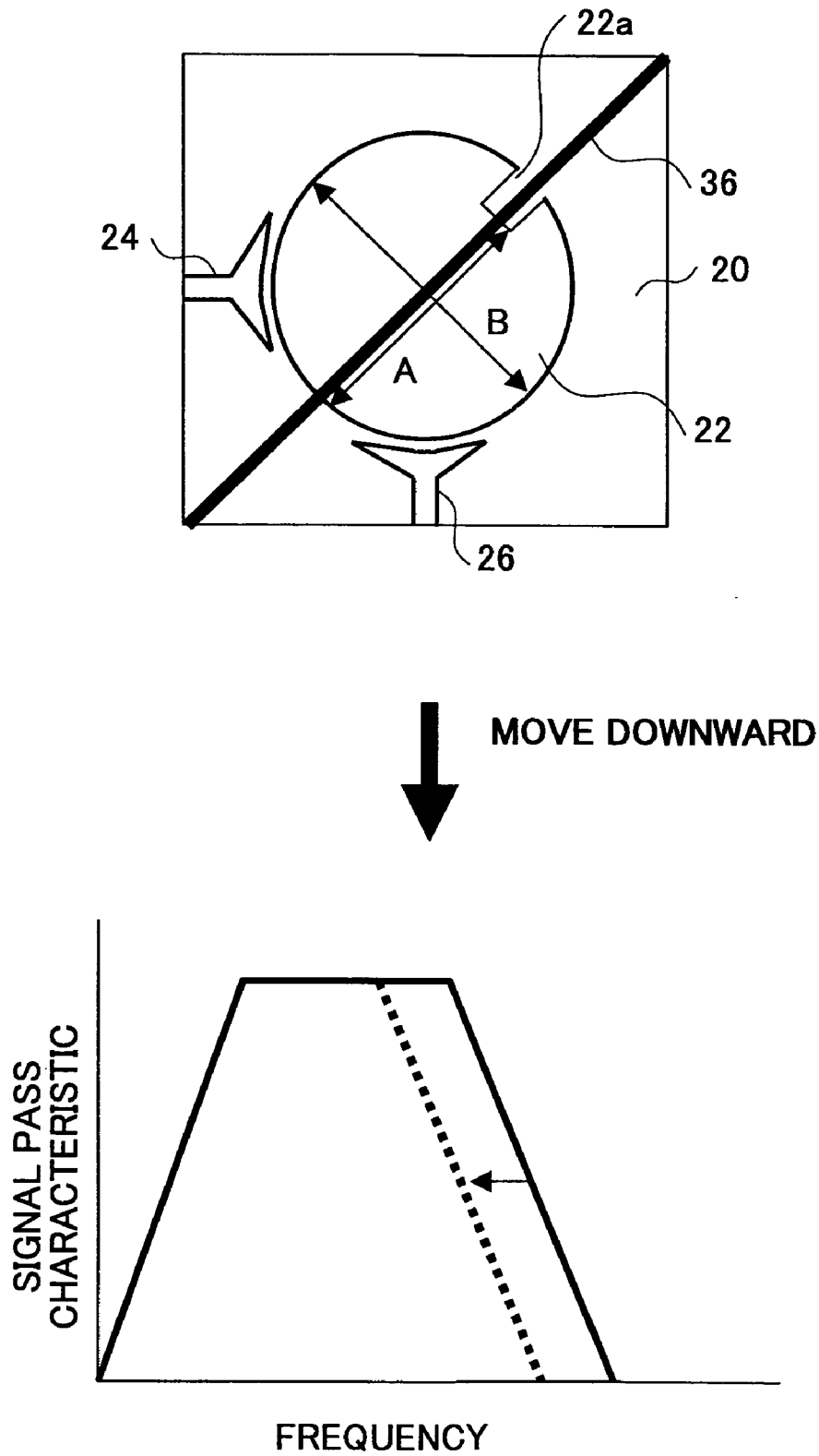
FIG. 10 is an illustration showing a change in a bandwidth when the adjust plate made of a dielectric material is arranged to extend in a direction along a diameter which passes a notch of the disc pattern.
Figure 11:
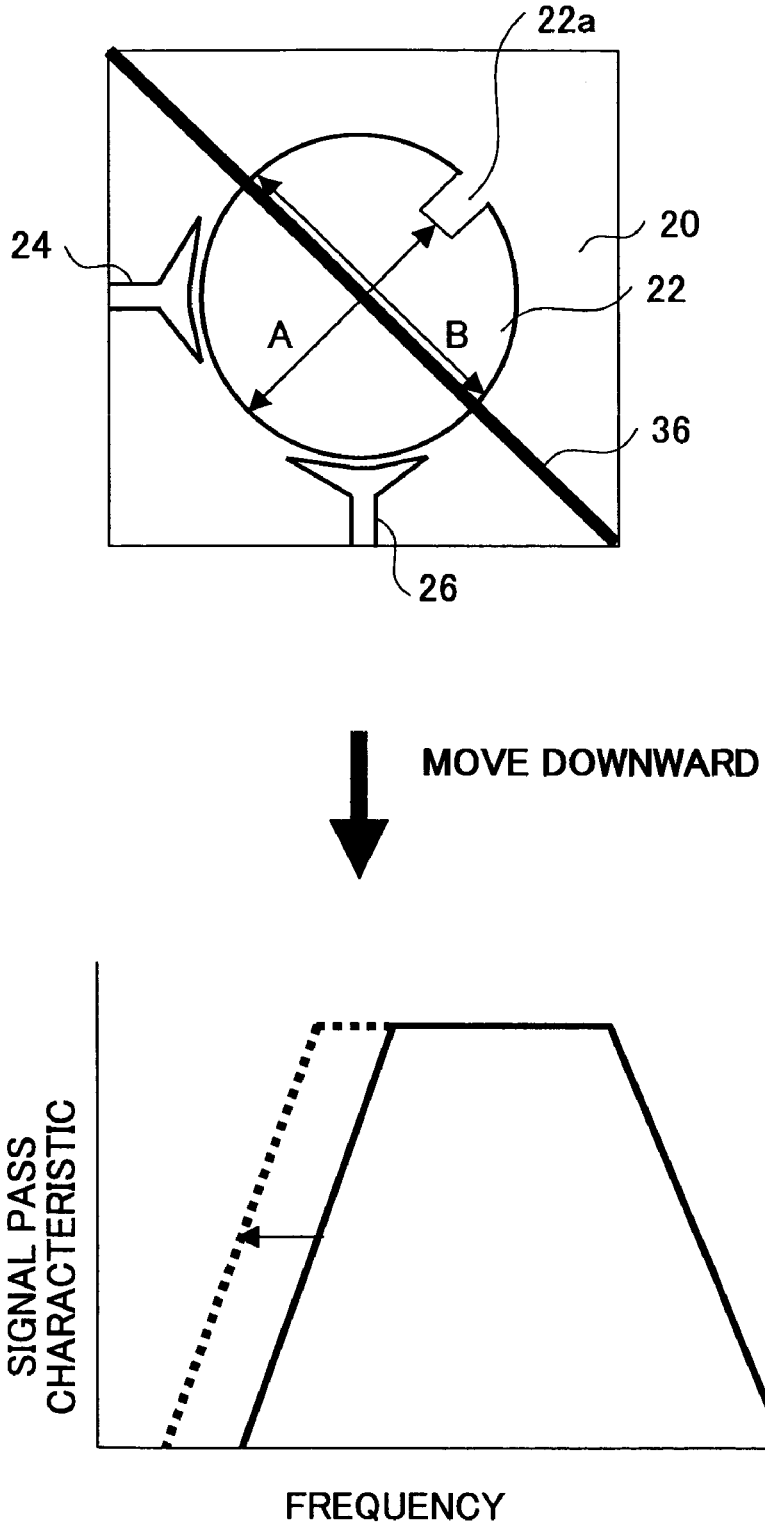
FIG. 11 is an illustration showing a change in a bandwidth when the adjust plate made of a dielectric material is arranged to extend in a direction perpendicular to a diameter which passes a notch of the disc pattern.

A description will now be given, with reference to FIGS. 10 and 11, of a superconducting filter device according to a second embodiment of the present invention.

In the above-mentioned first embodiment, the adjust plate is formed of an electrically conductive material (preferably, a superconducting material). On the other hand, in the present embodiment, the adjust plate is formed of a dielectric material. A structure of the superconducting filter device according to the second embodiment, except for the adjust plate 36 being formed of a dielectric material, is the same as the superconducting filter device according to the above-mentioned first embodiment, and a description thereof will be omitted.

The inventors performed experiments by making a trial manufacture of the superconducting filter device shown in FIG. 4 by using a normal conductor so as to verify that the bandwidth is changed. It should be noted that the adjust plate was formed by a dielectric material. A description will be given below of the experiments.

When producing a trial device for experiments, the disc pattern and the signal input and output lines were not formed by a superconductor material but formed by copper which is an excellent electrically conductive material. A MgO substrate was used as the substrate on which the disc pattern is formed.

First, a copper (Cu) film was formed on the 20×20×0.5 mm MgO substrate, and the Cu film was processed according to a photolithography so as to form the disc pattern 22 and the signal input and output lines 24 and 26 as shown in FIG. 5. Then, electrodes were formed on ends of the signal input and output lines 24 and 26.

The thus-formed substrate 20 was put in a metal package having a gold plated surface, and the electrodes of the superconducting filter are electrically connected to center conductors of coaxial connecters attached to the metal package. Thereafter, a gold plated cover was attached to the metal package so as to provide high-frequency shielding to complete the filter. Signal reflection and transmission characteristics of the filter were measured. The filter made as a trial had the center frequency of near 4 GHz, and a bandwidth of the filter was about 80 MHz.

Then, an adjust plate having a thickness of 1 mm, which is for adjusting the resonator coupling, was formed by a dielectric material ($LaAlO_3$), and the thus-formed adjust plate was attached to an inner side of the high-frequency shielding cover, and the characteristics of the filter are evaluated while changing the position (height) of the adjust plate. When the adjust plate was positioned along a diametral direction passing the notch of the disc pattern, the high-frequency end of the bandwidth (signal pass characteristic) shifted toward the lower frequency side as indicated by a dashed line in FIG. 10, and, it was found that the bandwidth is narrowed as the adjust plate is moved downward, that is, as the adjust plate is located closer to the disc pattern. On the other hand, when the adjust plate was positioned in a diametral direction perpendicular to the diametral direction passing the notch of the disc pattern, the low-frequency side of the bandwidth (signal pass characteristic) shifted toward the lower frequency side as indicated by a dashed line in FIG. 11, and, it was found that the bandwidth is enlarged as the adjust plate is moved downward, that is, as the adjust plate is located closer to the disc pattern.

Although $LaAlO_3$ was used as a dielectric material of the adjust plate in the trial device, the dielectric material is not limited to $LaAlO_3$, and, for example, $TiO_2$, MgO, $CeO_2$, $ZrO_2$, sapphire, $Al_2O_3$, etc., may be used as a dielectric material having a low transmission loss (low dielectric loss).

As explained in the above-mentioned first and second embodiments, a signal pass frequency bandwidth can be increased or decreased by arranging the adjust plate above the disc patter constituting the filter, and a center frequency of the signal pass frequency bandwidth can also be shifted. Additionally, if an electrically conductive material is used for the material of the adjust plate as in the first embodiment, the bandwidth can be enlarged toward a higher frequency, while the bandwidth can be enlarged toward a lower frequency by using a dielectric material as the material of the adjust plate as in the second embodiment. Accordingly, by selecting the material of the adjust plate between an electrically conductive material and a dielectric material based on a direction of adjustment of a signal pass frequency bandwidth, the bandwidth can be adjusted with a desired bandwidth and a desired center frequency.

The present invention is not limited to the specifically disclosed embodiments, and variations and modifications may be made without departing the scope of the present invention.

The present application is based on Japanese priority applications No. 2004-145377 filed May 14, 2004 and No. 2004-314094 filed Oct. 28, 2004, the entire contents of which are hereby incorporated herein by reference.

What is claimed is:

1. A superconducting filter device for filtering a high-frequency signal, comprising:

a substrate made of a dielectric material;

a disc-shaped filter pattern formed on the substrate and made of a superconductor material;

a signal input line and a signal output line each formed on said substrate so as to extend from a periphery of the filter pattern; and an adjust plate located above said filter pattern with a predetermined distance therebetween, wherein said adjust plate is positioned directly above and perpendicular to said disc-shaped filter pattern and the predetermined distance is provided between a lower edge of said adjust plate and said filter pattern.

2. The superconducting filter device as claimed in claim 1, wherein said adjust plate is formed of an electrically conductive material.

3. The superconducting filter device as claimed in claim 2, wherein said adjust plate is formed of copper.

4. The superconducting filter device as claimed in claim 1, wherein a thickness of said adjust plate is smaller than a distance between said signal input line and said signal output line.

5. The superconducting filter device as claimed in claim 1, wherein said substrate is accommodated in a metal package, a surface of said substrate on which said filter pattern is formed is covered by a cover of an electrically conductive material, and said filer pattern is located within an enclosed space formed by said cover and said metal package.

6. The superconducting filter device as claimed in claim 5, wherein said adjust plate is attached to an inner wall of said cover.

7. A superconducting filter device for filtering a high-frequency signal, comprising:

a substrate made of a dielectric material;

a filter pattern formed on the substrate and made of a superconductor material;

a signal input line and a signal output line each formed on said substrate so as to extend from a periphery of the filter pattern; and an adjust plate located above said filter pattern with a predetermined distance therebetween, wherein said adjust plate is positioned perpendicular to said filter pattern and the predetermined distance is provided between a lower edge of said adjust plate and said filter pattern, and wherein said adjust plate is formed of a superconductor material.

8. A superconducting filter device for filtering a high-frequency signal, comprising:

a substrate made of a dielectric material;

a filter pattern formed on the substrate and made of a superconductor material;

a signal input line and a signal output line each formed on said substrate so as to extend from a periphery of the filter pattern; and an adjust plate located above said filter pattern with a predetermined distance therebetween, wherein said adjust plate is positioned perpendicular to said filter pattern and the predetermined distance is provided between a lower edge of said adjust plate and said filter pattern, wherein said adjust plate is formed of a superconductor material, and wherein said superconductor material is selected from a group consisting of RBCO (element R is one of Y, Nd, Gd and Ho, and is a material of R—Ba—Cu—O), BSCCO (a material of Bi—Sr—Ca—Cu—O material), and CBCCO (CuBapCaqCurOx: $1.5<p<2.5$, $2.5<q<3.5$, $3.5<r<4.5$).

9. A superconducting filter device for filtering a high-frequency signal, comprising: a substrate made of a dielectric material; a filter pattern formed on the substrate and made of a superconductor material; a signal input line and a signal output line each formed on said substrate so as to extend from a periphery of the filter pattern; and an adjust plate located above said filter pattern with a predetermined distance therebetween, wherein said adjust plate is positioned perpendicular to said filter pattern and the predetermined distance is provided between a lower edge of said adjust plate and said filter pattern, and wherein said adjust plate comprises a base made of a dielectric material and a thin film of a superconductor material formed on a surface of the base.

10. A superconducting filter device for filtering a high-frequency signal, comprising:

a substrate made of a dielectric material;

a filter pattern formed on the substrate and made of a superconductor material;

a signal input line and a signal output line each formed on said substrate so as to extend from a periphery of the filter pattern; and an adjust plate located above said filter pattern with a predetermined distance therebetween, wherein said adjust plate is positioned pendicular to said filter pattern and the predetermined distance is provided between a lower edge of said adjust plate and said filter pattern, and awherein said adjust plate is formed of a dielectric material.

11. The superconducting filter device as claimed in claim 10, wherein said dielectric material is selected from a group consisting of $LaAlO_3$, $TiO_2$, MgO, $CeO_2$, $ZrO_2$, sapphire and $Al_2O_3$.

12. A superconducting filter device for filtering a high-frequency signal, comprising:

a substrate made of a dielectric material;

a filter pattern formed on the substrate and made of a superconductor material;

a signal input line and a signal output line each formed on said substrate so as to extend from a periphery of the filter pattern; and an adjust plate located above said filter pattern with a predetermined distance therebetween, wherein said adjust plate is positioned perpendicular to said filter pattern and the predetermined distance is provided between a lower edge of said adjust plate and said filter pattern, and wherein said filter pattern has a substantially circular shape, and one of a notch and a protrusion is provided on a part of an outer circumference of said filter pattern.

13. The superconducting filter device as claimed in claim 12, wherein said one of the notch and the protrusion has a rectangular shape.

14. The superconducting filter device as claimed in claim 12, wherein said adjust plate extends along a diametral line of said filter pattern passing said one of the notch and the protrusion.

15. The superconducting filter device as claimed in claim 12, wherein said adjust plate extends along a diametral line of said filter pattern perpendicular to a diametral line of said filter pattern passing said one of the notch and the protrusion.

* * * * *